US005186158A

United States Patent [19]

Ferlin

[11] Patent Number: 5,186,158

[45] Date of Patent: Feb. 16, 1993

[54] GAS BURNER

[75] Inventor: William J. Ferlin, Plymouth, Mich.

[73] Assignee: Lincoln Brass Works, Inc., Detroit, Mich.

[21] Appl. No.: 571,185

[22] Filed: Aug. 23, 1990

[51] Int. Cl.[5] ..... F24C 3/00

[52] U.S. Cl. ..... 126/39 H; 431/354; 239/557; 126/39 R

[58] Field of Search ..... 126/39 R, 39 D, 39 E, 126/39 H, 39 N, 39 J, 39 K; 431/264, 266, 354; 239/548, 552, 557

[56] References Cited

U.S. PATENT DOCUMENTS 3,799,142 3/1974 Jensen ..... 126/39 R X
3,830,216 8/1974 Dodd ..... 126/39 J
3,922,138 11/1975 Biddle et al. ..... 126/39 R X
4,130,104 12/1978 Kristen et al. ..... 126/39 J
4,541,407 9/1985 Sommers et al. ..... 126/39 R X
4,565,523 1/1986 Berkelder ..... 126/39 E X
4,626,196 12/1986 Stohrer, Jr. ..... 126/39 E X
4,627,411 12/1986 Mertler ..... 126/39 E
4,846,671 7/1989 Kwiatek ..... 126/39 E X
4,953,534 9/1990 DeGouville et al. ..... 126/39 H

*Primary Examiner*—Larry Jones
*Attorney, Agent, or Firm*—Harness, Dickey & Pierce

[57] ABSTRACT

A burner for a "sealed top" range which has a generally upwardly diverging conical body which radially disposed fuel ports and a generally flat removable cap disposed on the upper periphery of the body. Alternative cap designs and electric igniters are are also disclosed.

24 Claims, 2 Drawing Sheets

GAS BURNER

BACKGROUND AND SUMMARY OF THE INVENTION

The present invention relates to range top burners, and more particularly to an improved burner specifically adapted to be used in a range requiring "sealed top" burners.

One of the current trends in the design of gas fired kitchen ranges is the use of sealed top burners. This is an arrangement wherein there is no annular gap or air space around the burner: i.e., the top of the range engages the entire periphery of the burner. This provides a cleaner look, and is actually cleaner because spillover material cannot now go down into the burner box below the former, but remains on top where it may be easily wiped up. Ranges of this type provide different problems and needs than those of a conventional range top.

It is therefore a primary object of this invention to provide an extremely simple and inexpensive burner, comprising only a few parts, which has good efficiency and is particularly suited for use on a sealed top range. A related object resides in the provision of such a burner which is ideally suited for incorporation of electronic ignition, with the igniter disposed either inside or outside of the burner itself. A further object resides in the provision of an alternative extra light-weight version of a burner cap.

These and other objects and advantages will become more apparent when viewed in light of the accompanying drawings and following detailed description.

BRIEF DESCRIPTION OF THE DRAWING FIGURES

DETAILED DESCRIPTION OF THE PREFERRED EMBODIMENTS

Figure 1:
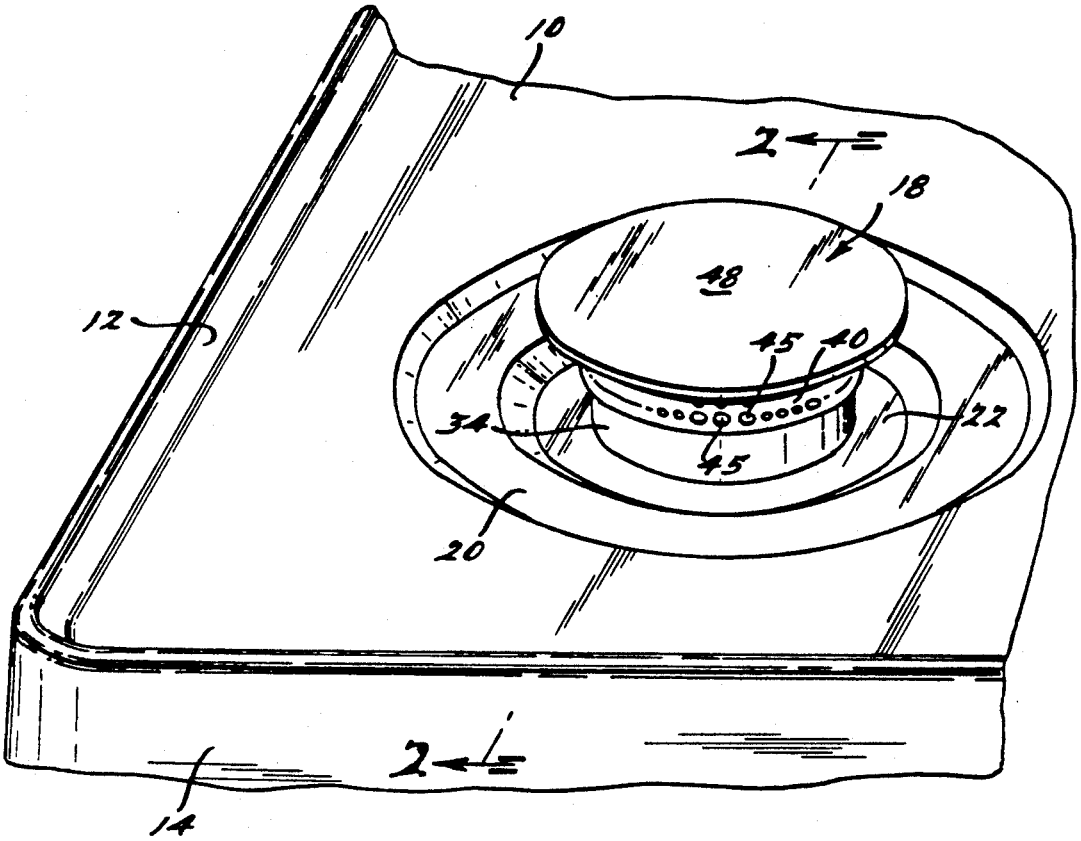
FIG. 1 is a perspective view of a portion of a conventional sealed top range incorporating the burner of the present invention but with the trivit removed.

The range incorporating the burner of the present invention comprises a generally horizontal top partition 10 connected via a lip 12 to side walls 14, and an intermediate partition 16 disposed below and generally parallel to top partition 10 and defining a burner box therebetween. Most ranges have a plurality of burners, but because they are usually all the same only one burner, indicated at 18, will be described herein. At the location of each burner 18 top partition 10 has a first depressed annular recess 20 and a second concentric further depressed annular recess 22 defining an opening 24 through top partition 10. A conventional trivit 26 is disposed in recess 20 and burner 18 is disposed in recess 22 overlying opening 24. A conventional gas nozzle 28, supplied by gaseous fuel line 30, is mounted on intermediate partition 16 in a position for directing gaseous fuel, and ambient air, vertically upwardly into opening 24 and burner 18.

Figure 4:
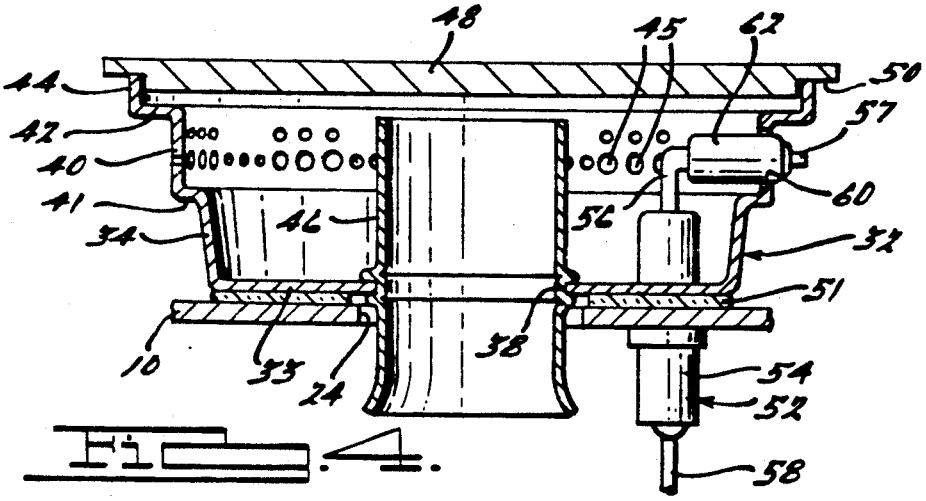
FIG. 4 is a is a vertical sectional view of the burner of the present invention showing the ignition in an alternative location.
Figure 2:
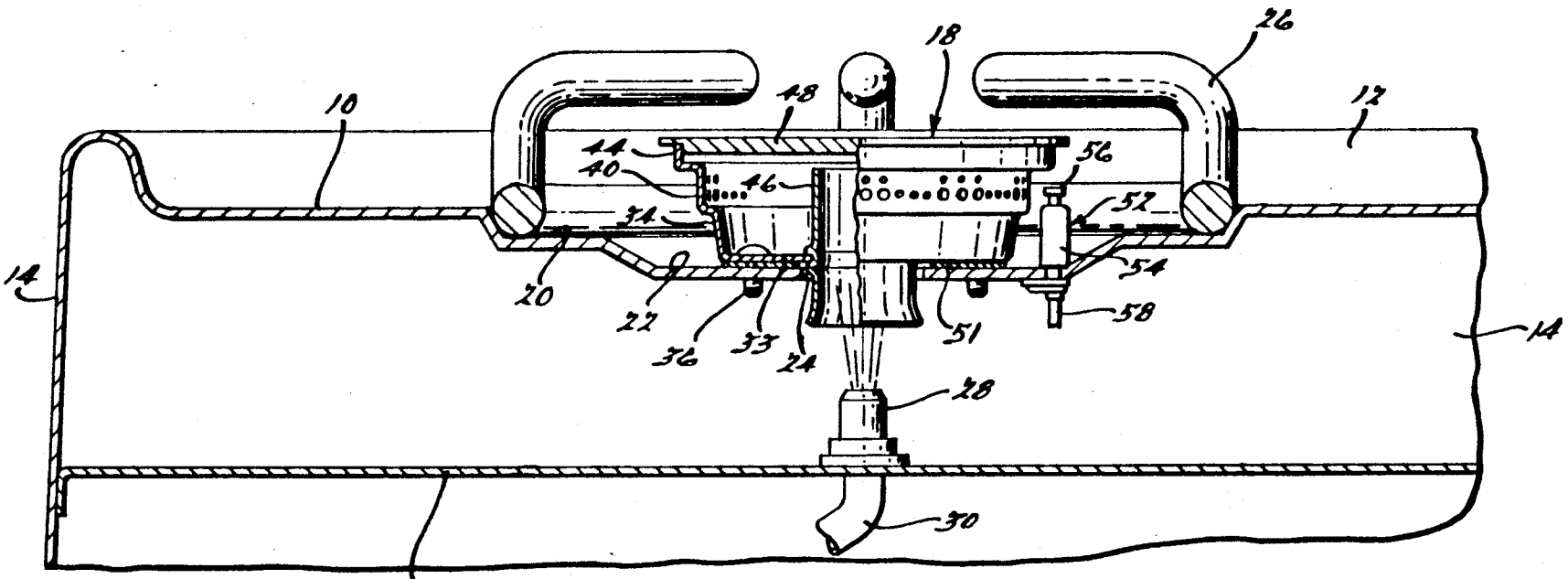
FIG. 2 is a is a sectional view taken substantially along line 2—2 in FIG. 1.

The burner of the present invention generally comprises a one-piece upwardly open generally cup-shaped sheet-metal burner body 32 of generally circular cross-section and having a generally flat annular bottom wall 33 fastened to top partition 10 by means of a plurality of fasteners 36, a gaseous fuel and air inlet port 38 (FIG. 4) disposed in alignment with opening 24, a generally cylindrical but slightly conical lower portion 34 joining the outer periphery of bottom wall 33 and extending upwardly and slightly outwardly therefrom, a generally cylindrical upper portion 40 joining the upper periphery of lower portion 34 via a generally horizontal annular flange 41 and having a diameter greater than that of lower portion 34, a first flange 42 extending radially outwardly from the upper periphery of upper portion 40, a second flange 44 extending upwardly from the outer periphery of first flange 42, a plurality of radially directed flame ports 45 extending through upper portion 40, a generally cylindrical venturi or gas mixing tube 46 having an outwardly flared lower end centrally disposed in body 32 and affixed, by upsetting or crimping, to the edge of inlet port 38, and a generally horizontal circular flat imperforate burner cap 48 loosely supported by the upper periphery of second flange 44, said cap being of an outside diameter slightly greater than that of second flange 44. Cap 48, as shown in FIGS. 1, 2 and 4, is a relatively heavy casting, formed of cast iron, glass (clear or opaque) or the like, which can be easily lifted off for cleaning or service of the burner. An annular notch 50 around the periphery thereof retains it in position on body 32. Removal of the entire burner is easily accomplished by removing the cap and then fasteners 36. Preferably a layer 51 of heat insulating and electrically non-conductive material is disposed between burners 18 and partition 16 to isolate the two elements.

If desired, the burner of this invention may be provided with an electric igniter 52. In FIG. 2 igniter 52 is located outside the burner and comprises an insulating body 54 extending through and affixed to partition 10 and an electrode 56 projecting from the upper end thereof in close proximity to the burner. Electricity is supplied using conventional circuitry via a wire 58 which is connected to electrode 56. When energized, an electric potential is created between electrode 56 and metal burner body 32 to cause a spark to arc therebetween and ignite the gasous fuel issuing from ports 45. In FIG. 4 igniter 52 is disposed in an alternative position inside burner body 32. This igniter is the same as the one in FIG. 2 except that the upper end of electrode 56 projects radially outwardly, as at 57, through an opening 60 in body 32 to a point in close proximity to the body so the necessary electrical arc may be created. To prevent a short circuit, electrode portion 57 is disposed within an insulating sleeve 62 which also extends through opening 60, with a slight clearance therebetween to provide an additional gaseous fuel passage. This embodiment of the igniter is described in greater detail in applicant's copending application for U.S. Letters Patent Ser. No. 255,514, filed Oct. 11, 1988, the disclosure of which is herein incorporated by reference. Note than in both embodiments cap 48 is of a sufficient diameter, and body 32 is so contoured, that normal spillage will not hit the igniter (and possibly cause electrical shorts) or the flame ports.

Figure 3:
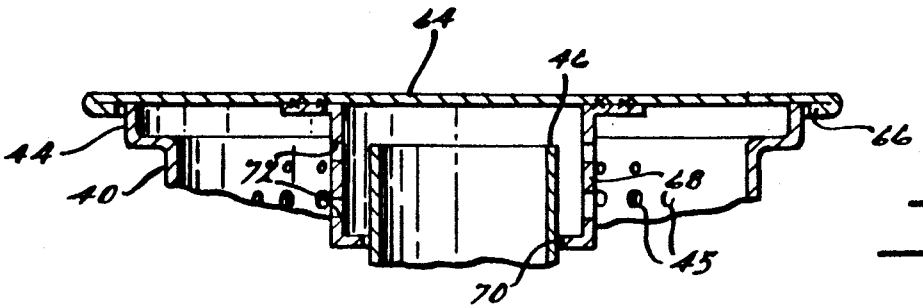
FIG. 3 is a is a vertical sectional view of another embodiment of a burner cap forming part of the present invention.

In FIG. 3 there is illustrated a less expensive sheet metal version of a burner cap, comprising a generally horizontal flat body 64 having the outer periphery folded back on itself as shown at 66, and having affixed to the bottom thereof, as by welding or brazing in the manner shown, a centrally located generally channel-shaped bracket 68 having an opening 70 through the bight portion thereof which is slightly larger than and adapted to loosely receive mixing tube 46. A plurality of ports 72 may be provided through the side wall of bracket 68 to facilitate the flow of gaseous fuel to ports 45. Tube 68 functions to stabilize the relatively light weight cap in its assembled position; however, the cap may still be easily lifted off for cleaning or burner service.

While this invention has been described in connection with these particular examples, no limitation is intended except as defined by the following claims. The skilled practitioner will realize that other modifications may be made without departing from the spirit of this invention after studying the specification and drawings.

I claim:

1. A range-top burner for a sealed top range, comprising:

(a) an upwardly diverging generally conical body;

(b) a plurality of generally radially disposed fuel ports in said body;

(c) a generally flat easily removable cap disposed on and supported by the upper periphery of said body, the outside of said cap being greater than the outside diameter of the upper periphery of said body, the outer periphery of said cap being folded under to define an inwardly facing annular shoulder, the upper periphery of said body being disposed inside said shoulder.

2. A range-top burner as claimed in claim 1 wherein said cap is formed of a relatively heavy cast metal.

3. A range-top burner as claimed in claim 2 wherein said cap has an annular notch in the lower portion of the outer periphery thereof, the upper periphery of said body being disposed in said notch.

4. A range-top burner as claimed in claim 1 wherein said cap is formed of relatively light-weight sheet metal.

5. A range-top burner as claimed in claim 4 wherein said burner has a gas mixing tube disposed therein and said cap has affixed to the inside surface therof a bracket which loosely engages said mixing tube.

6. A range-top burner as claimed in claim 1 wherin said body includes an integral generally annular bottom portion defining a central gaseous fuel inlet opening therethrough.

7. A range-top burner as claimed in claim 6 further comprising a mixing tube in said body in fluid communication with said opening.

8. A range-top burner as claimed in claim 7 wherein said mixing tube is affixed to the periphery of said opening.

9. A range-top burner as claimed in claim 7 wherein said mixing tube has an outwardly flared lower end.

10. A range-top burner as claimed in claim 1 further comprising an electronic igniter disposed closely adjacent said body, said cap overlying said igniter.

11. A range-top burner as claimed in claim 10 wherein said igniter is disposed outside said body.

12. A range-top burner as claimed in claim 10 wherein said igniter is disposed inside said body.

13. A range-top burner as claimed in claim 1 wherein said cap is formed of relatively heavy high temperature glass.

14. A sealed top range, comprising:

(a) a range housing having a generally horizontal top partition defining a range top surface;

(b) means defining an opening in said top;

(c) an intermediate partition disposed below and spaced from said top partition;

(d) a gas nozzle affixed to said intermediate partition for introducing gaseous fuel upwardly through said opening;

(e) means for supplying gaseous fuel to said nozzle;

(f) a burner affixed to said top partition and overlying said opening, said burner being generally circular in cross-section and comprising:

(1) an upwardly diverging generally conical body;

(2) a plurality of generally radially disposed fuel ports in said body;

(3) a generally flat easily removable cap disposed on and supported by the upper periphery of said body, the outside diameter of said cap being greater than the outside diameter of the upper periphery of said body.

15. The range-top burner as claimed in claim 14 further comprising an electronic igniter disposed closely adjacent said body, said cap overlying said igniter.

16. The range-top burner as claimed in claim 14 further comprising an electronic igniter disposed closely adjacent to and outside of said body.

17. A range-top burner for a sealed top range, comprising:

(a) a one-piece upwardly open generally cup-shaped burner body, said body being generally circular in cross-section and including:

(1) a generally flat annular bottom wall defining a gaseous fuel and air inlet port, (2) a generally cylindrical lower portion joining said bottom wall and extending upwardly and slightly outwardly from the outer periphery thereof, (3) a generally horizontal annular intermediate body portion extending radially outwardly from the upper periphery of said lower portion, (4) a generally cylindrical upper portion extending upwardly from the outer periphery of said intermediate portion and having a diameter greater than that of said lower portion, (5) a first flange extending radially outwardly from the upper periphery of said upper portion, (6) a second flange extending upwardly from the outer periphery of said first flange, and (7) means defining a plurality of radially directed flame ports extending through said upper portion; and (b) a generally horizontal circular flat imperforate burner cap disposed on said mounting flange, said cap being of a diameter slightly greater than that of said mounting flange.

18. A range-top burner as claimed in claim 17 further comprising a generally cylindrical mixing tube centrally disposed in said body and affixed to said bottom wall in alignment with said inlet port.

19. A sealed top range, comprising:

(a) a range housing having a generally horizontal top partition defining a range top surface;

(b) means defining an opening in said top;

(c) an intermediate partition disposed below and spaced from said top partition;

(d) a gas nozzle affixed to said intermediate partition for introducing gaseous fuel upwardly through said opening;

(e) means for supplying gaseous fuel to said nozzle;

(f) a one-piece upwardly open generally cup-shaped burner body affixed to said top partition and overlying said opening, said body being generally circular in cross-section and comprising;

(1) a generally flat annular bottom wall fastened to said top partition and defining a gaseous fuel and air inlet port disposed in alignment with said opening, (2) a generally cylindrical lower portion joining said bottom wall and extending upwardly and slightly outwardly from the outer periphery thereof, (3) a generally horizontal annular intermediate body portion extending radially outwardly from the upper periphery of said lower portion, (4) a generally cylindrical upper portion extending upwardly from the outer periphery of said intermediate portion and having a diameter greater than that of said lower portion, (5) a first flange extending radially outwardly from the upper periphery of said upper portion, (6) a second flange extending upwardly from the outer peripher of said first flange, and (7) means defining a plurality of radially directed flame ports extending through said upper portion; and (b) a generally horizontal circular flat imperforate burner cap disposed on said mounting flange, said cap being of a diameter slightly greater than that of said mounting flange.

20. A range-top burner as claimed in claim 19 further comprising a generally cylindrical mixing tube centrally disposed in said body and affixed to said bottom wall in alignment with said inlet port.

21. A range-top burner for a sealed top range, comprising:

(a) a generally cup-shaped body having a generally flat annular bottom wall defining a central gaseous fuel inlet opening therethrough;

(b) a plurality of generally radially disposed fuel ports in said body;

(c) a generally flat easily removable cap disposed on and supported by the upper periphery of said body, the outside diameter of said cap being greater than the outside diameter of the upper periphery of said body and the outer periphery of said cap being folded under to define an inwardly facing annular shoulder, the upper periphery of said body being disposed inside said shoulder; and (d) a generally cylindrical venturi having an outwardly flared lower end centrally disposed in said bottom wall so as to be in fluid communication with said opening.

22. The range top burner as claimed in claim 21 wherein said venturi extends upwardly substantially to said upper periphery of said body.

23. The range-top burner as claim 21 wherein said cup-shaped body further comprises a single-walled, generally cylindrical portion extending upwardly from said bottom wall, said fuel ports being disposed in said single-walled portion.

24. A range-top burner for a sealed top range, comprising:

(a) a one piece upwardly open generally cup-shaped body having an integral generally flat annular bottom wall defining a central gaseous fuel inlet opening therethrough;

(b) a plurality of generally radially disposed fuel ports in said body; and (c) a generally flat easily removable cap disposed on and supported by the upper periphery of said body, with the outside diameter of said cap being greater than the outside diameter of the upper periphery of said body, and the outer periphery of said cap being folded under to define an inwardly facing annular shoulder, the upper periphery of said body being disposed inside said shoulder.

* * * * *

UNITED STATES PATENT AND TRADEMARK OFFICE

CERTIFICATE OF CORRECTION

PATENT NO. : 5,186,158

DATED : February 16, 1993

INVENTOR(S) : William J. Ferlin

It is certified that error appears in the above-identified patent and that said Letters Patent is hereby corrected as shown below:

Title page, item [57],

In the Abstract, line 2, "which" should be — with —.

In the Abstract, line 5, delete "are" (second occurrence).

Column 1, line 41, delete "is a" (second occurrence).

Column 1, line 43, delete "is a" (second occurrence).

Column 1, line 46, delete "is a" (second occurrence).

Column 2, line 65, "than" should be — that —.

Column 3, line 31, after "outside" insert — diameter —.

Column 3, line 47, "therof" should be -- thereof —.

Column 3, line 49, "wherin" should be -- wherein —.

Column 5, line 29, "peripher" should be — periphery --.

UNITED STATES PATENT AND TRADEMARK OFFICE

CERTIFICATE OF CORRECTION

PATENT NO. :5,186,158
DATED :February 16, 1993
INVENTOR(S) :William J. Ferlin

It is certified that error appears in the above-indentified patent and that said Letters Patent is hereby corrected as shown below:

Column 6, line 21, after "as" insert -- claimed in --.

Signed and Sealed this

Twenty-first Day of December, 1993

*Attest:*

Bruce Lehman

BRUCE LEHMAN

*Attesting Officer*

*Commissioner of Patents and Trademarks*